United States Patent [19]

Bachot et al.

[11] 3,980,613

[45] Sept. 14, 1976

[54] METHOD OF MANUFACTURING ELECTROLYSIS CELL DIAPHRAGMS

[75] Inventors: Jean Bachot, Sceaux; Pierre Bouy, Enghien-les-Bains; Michel Juillard, Orsay, all of France

[73] Assignee: Rhone-Progil, Courbevoie, France

[22] Filed: May 14, 1974

[21] Appl. No.: 469,808

[30] Foreign Application Priority Data

May 18, 1973 France ..... 73.18805

[52] U.S. Cl. ..... 264/45.3; 204/296; 260/29.6 F; 264/46.7; 264/49; 264/127; 264/259; 264/271

[51] Int. Cl.[2] ..... B29D 27/04

[58] Field of Search ..... 264/127, 49, 87, 259, 264/271; 260/29.6 F

[56] References Cited

UNITED STATES PATENTS

| | | | |
|---|---|---|---|
| 3,235,636 | 2/1966 | Trimble | 264/127 |
| 3,692,727 | 9/1972 | Peschko | 260/29.6 F |
| 3,930,979 | 1/1976 | Vallance | 204/296 X |

FOREIGN PATENTS OR APPLICATIONS

| | | | |
|---|---|---|---|
| 1,491,033 | 6/1967 | France | 264/127 |
| 2,140,714 | 3/1972 | Germany | 264/127 |
| 1,410,313 | 10/1975 | United Kingdom | 264/127 |

*Primary Examiner*—Philip Anderson

[57] ABSTRACT

A uniform, porous, homogeneous diaphragm for use in electrolysis cells is provided by bringing together a homogeneous, stable suspension of asbestos fibers in water and a fluorinated polymeric resin latex with a pore-forming agent in the presence of a sulfonated anionic surfactant, the resulting suspension being shaped to the desired form of the diaphragm by filtration, the desired shape of the diaphragm then being dried and sintered at a temperature above the crystalline melting point of the fluorinated polymeric resin, the pore-forming agent finally being removed from the resulting diaphragm by decomposition or extraction.

12 Claims, No Drawings

METHOD OF MANUFACTURING ELECTROLYSIS CELL DIAPHRAGMS

BACKGROUND OF THE INVENTION

The present invention relates to a method of manufacturing diaphragms of deposited asbestos, consolidated by a fluorinated polymer resin, which are of adjustable porosity and can be used in electrolysis cells, as well as the new diaphragms thus obtained.

Diaphragm cells for use in the electrolysis of salts have been known for a long time. See "Chlorine, Its Manufacture, Properties And Use," by J. S. Sconce, American Chemical Society Monograph, Series No. 154, page 105, (Reinhold Publishing Corp. New York). However, the mechanism of their operation is not fully known. The diaphragms, as is well known, are placed between the anodic and cathodic components of the cells and act as a filter between anolyte and catholyte.

In general, in order for a diaphragm to be adapted properly to electrolysis conditions, it must be uniform in dimensions and texture and withstand corrosion in acid or alkaline hot chlorinated medium. This diaphragm behaves like a porous medium permitting both the passage of the current with a small ohmic drop and the uniform flow of the electrolyte from one compartment of the electrolysis to another.

In the case of the manufacture of caustic alkali from sodium chloride, the flow of the hydroxide ions in the direction opposite to the flow of liquid which is responsible for the formation of chlorates must be reduced to a minimum. In order to decrease this reverse flow, one can control the diaphragm by simultaneously increasing its thickness and decreasing its porosity, but the permeability of this diaphragm must, however, be sufficient for the percolation to take place with a loss in pressure head which is compatible with the requirements of the system. For a given permeability of the diaphragm, there will correspond a loss in head which is a function of the rate of flow of liquid. It will be necessary to adapt the diaphragm to the given conditions of current density and operation of the electrolysis permitting the best possible compromise between the chemical efficiency (loss of chlorine by formation of chlorate) and the electrical efficiency (drop of voltage in the diaphragm and loss of current by Joule effect).

The combination of electrical, chemical and hydraulic conditions indicated above is combined satisfactorily in those diaphragms obtained by the mere deposition of asbestos fibers on the cathode from a bath, for a current density close to 15 amperes per square decimeters of surface of electrode and diaphragm. This method of deposition is, on the other hand, poorly adapted to the operating conditions of electrolysis cells which are subjected to a higher current density unless ohmic drops which prove to be economically prohibitive are to be tolerated. The mere depositing of the asbestos fibers can lead only to structures having porosities which are difficult to control. It furthermore has the drawbacks of unconsolidated structures, namely: (1) a swelling during electrolysis, which requires a minimum interpolar distance, (2) the difficulty in obtaining sufficiently small deposits of asbestos having a low ohmic drop, and (3) the unstable state of the resulting diaphragm which, after the starting up of the electrolysis and stabilization, only very poorly withstands the incidents of operation and changes in situ and in the cell.

For these reasons, the industry has turned recently to the production of porous plastic diaphragms. The principle involved is well known. It consists in producing a composite having a base of asbestos and a polymer which is inert towards the electrolyte, with the possible presence of a pore former which is decomposed at the end of the operation to produce the required porosity.

Numerous references are to be found relating to such diaphragms. Mention may be made more particularly to the following patents which employ techniques of compression preforming followed by fritting, or techniques of coagulation of the mixture or depositing of this mixture on a support.

Thus French patent No. 1,491,033 of Aug. 31, 1966, describes a process of manufacturing a porous diaphragm which consists in mixing a solid additive in particulate form into an aqueous dispersion of polytetrafluoroethylene in the presence of particulate inorganic fillers, then coagulating the dispersion, placing the resulting coagulum in sheet form, and finally removing the solid particulate additive from the sheet. The additive generally consists of starch or calcium carbonate and is removed at the end of the operation by immersing the resultant sheet in hydrochloric acid to dissolve the additive. This additive may also be a plastic polymer which is soluble in an organic solvent, or depolymerizable, or else evaporatable by heating the sheet. The particulate inorganic fillers which are suitable are barium sulfate, titanium dioxide or powdered asbestos. They are used in proportions of between 40 and 70% of the weight of polytetrafluoroethylene contained in the dispersion.

British patent No. 943,624 of Dec. 14, 1961, proposes a method of producing a filter material which consists in mixing polytetrafluoroethylene in powder form with an eliminatable powdered material, subjecting the mixture to preforming under high pressure, and then sintering the resultant shape at a temperature which does not affect the polymer, the powdered material being eliminated either by volatilization at the sintering temperature or by the addition of solvents in which it is solubilized.

German application No. 2,140,714 of Aug. 13, 1971 claims a process of manufacturing diaphragms having a base of inorganic fibers, particularly asbestos, which are bonded by a fluorinated resin. The membrane can be obtained by impregnating a paper or fabric, or else produced by the introduction of fibers into the resin suspension and shaping in accordance with a papermaking method. The sintering is then effected under elevated pressure.

All of these foregoing prior art techniques, however, have a number of drawbacks, namely:

1. Providing flat diaphragms only, either because the use of calendering or pressing makes any other shapes impossible, or that the initial suspensions, in particular when they are coagulated, do not have sufficient properties to permit homogeneous deposits on supports of complex shape.

2. Difficulties, in the case of membranes rich in polytetrafluoroethylene, in producing membranes of satisfactory mechanical properties (permitting large flow) and of good wettability.

3. Low percentage of voids is permitted in the diaphragm structure. In order to obtain good mechanical properties and excellent conservation of the cohesion during electrolysis, the quantities of pore-forming agents used are zero or low, namely, 200–300%, or less, by weight of material. Under these circumstances, the performances in the electrolysis of sodium chloride are not truly of interest — rather large ohmic drop or low Faraday yield, resulting from the reduced porosity of the diaphragm.

Other prior art is also less than satisfactory. British patent No. 1,160,084, published July 30, 1969, discloses membranes and diaphragms produced from a matrix of a fluorocarbon polymer and a combustible fibrous substrate, such as of cellulose, which can be burned out of the matrix. The resulting product is porous in nature, due to the voids left by the burning of the cellulose. According to the patent asbestos in the diaphragm is to be avoided.

British patent No. 1,063,244, published Mar. 30, 1967 describes a porous medium which is unsuitable for use in electrolysis cells. It is comprised of a porous base, such as of paper, having fibers, such as of asbestos, adhered to the surface, with the aid of a polymeric binder.

It is, accordingly, an object of the present invention to provide a novel and improved method of producing diaphragms suitable for electrolysis cells.

It is also an object of the invention to provide and an improved method of producing diaphragms which are free from the deficiencies of the prior art.

The applicant has now discovered a process which is simple and interesting to carry out and which forms one of the objects of the present invention.

GENERAL STATEMENT OF THE INVENTION

The objectives of the present invention concern a process of manufacturing porous diaphragms of deposited asbestos which are consolidated by a fluorinated polymeric resin, which comprises the steps of adding a fluorinated polymeric resin latex and a pore-forming agent to a homogeneous, stable suspension of asbestos fibers in water and in the presence of a surfactant of the sulfonic anionic type, the resulting suspension being shaped to the desired form by filtration and the desired shape then being dried and sintered at a temperature above the crystalline melting point of the fluorinated polymeric resin, the pore-forming agent being removed by decomposition or extraction.

The excellent stability of the suspension and the excellent dispersion of the asbestos fibers makes it possible to obtain very uniform and homogeneous deposited layers or diaphragms of adjustable electrical and hydrodynamic characteristics, and having uniform pore sizes. The diaphragms thus produced hold together very well, despite the high percentage of pores and the absence of the use of calendering or other pressure treatment. During their use in electrolysis, they retain their coherence and provide high performance at all current densities.

The introduction of the pore former in suitable particle size and quantity makes it possible to obtain the desired values of permeability and relative resistance.

One of the main difficulties in the preparation of suitable diaphragms consists in imparting to the initial suspension sufficient properties to permit good production of the diaphragm. The conditions for the preparation having been determined, i.e., properly selected proportion of the different ingredients, precise adjustment of the speed and the time of agitation, and the concentration of components, the desired properties are obtained by the use of sulfonic anionic surfactants, in particular the alkyl sulfonates, sulfosuccinates and sulfosuccinamates, and their salts. Particularly suitable is sodium dioctylsulfosuccinate. The proportions of surfactant to be employed may vary from between about 2 and 10% by weight, based on the amount of asbestos used.

The desired variation in thickness of the diaphragm is obtained easily depending upon the quantity of suspension deposited during the shaping operation. For this purpose, one proceeds under the same conditions as those presently used to deposit asbestos slurries, the vacuum program during the shaping operation being adapted to the desired thickness and the nature of the cathode or the support. For the production of flat diaphragms, the procedure can be simplified and, for instance, a variable weight of the initial suspension deposited by complete filtration. This technique furthermore makes it possible to produce diaphragms whose texture can vary very greatly with respect to thickness by modification of the composition of the suspension during the filtration. This is a favorable factor for use in electrolysis.

After drying above 100°C., the diaphragm is sintered for a given period of time at a temperature above the crystalline melting point of the fluorinated polymer. The conditions of temperature and time during the sintering operations vary with the thickness and composition of the diaphragm to be formed. The presence of the pore-former during the sintering operations reinforces the resistance to degradation of the porous structure by collapse of the softened mass. However, the range of temperature must be selected carefully, as too low a temperature gives the diaphragm insufficient coherence and too high a temperature leads to degradation. The diaphragms obtained by sintering under excessively low or excessively high conditions of temperature deteriorate during the electrolysis by cleavage and formation of pockets of gas with abnormal increase in the voltage drop.

In the practice of the process, a suspension of asbestos is prepared by dispersing, by means of agitation, a mixture containing by weight:

1. — 1 part of asbestos
2. — about 5 to 100 parts of water
3. — about 0.02 to 0.1 part of the anionic surfactant The asbestos used is composed preferably of fibers of about 0.05 to 50 millimeters in length. The anionic surfactant, preferably sodium sulfosuccinate, is used either in the pure state or in alcoholic solution. By vigorous agitation, a well dispersed stable asbestos suspension is obtained. Other anionic surfactants, such as the alkyl sulfonates and sulfosuccinamates also produce satisfactory results.

The latex of the fluorinated resin and the pore-former are added to this suspension in accordance with the following proportions by weight:

1. — 100 parts of asbestos
2. — about 60 to 200 parts of the fluorinated resin, on a dry basis,
3. — about 200 to 1400 parts of pore-former The resulting suspension is desirably agitated for about 1 to 20 minutes, and preferably 5 to 10 minutes, at a desirable speed of agitation. The final concentration of the suspension can be adjusted by the addition of water at the end of the agitation to the proportions best adapted to the deposition conditions employed.

The polytetrafluoroethylene latex is generally a suspension of the order of 60% polytetrafluoroethylene in water. It can be replaced by other fluorinated resin latices (mixture of tetrafluoroethylene-hexafluoropropylene, polychlorotrifluoroethylene, copolymers of these, etc.).

The pore-former used may be calcium carbonate, colloidal alumina, metallic oxides or any product capable of being eliminated by solvent extraction or by decomposition at the end of the operation. It should have a well defined particle size. There is preferably employed a calcium carbonate formed of particles of an average diameter of between about 2 and 25 microns.

For the manufacture of a flat diaphragm, the homogeneous, stable suspension of the various components is poured onto a fine grid or screen in sufficient quantity to obtain the desired thickness. Filtration is then effected under vacuum, the form or shape obtained is detached from the grid and then dried. This drying is effected at a temperature above 100°C., of the order of 150°C., for 24 hours.

The plate is then sintered by bringing it in a furnace to a temperature above the crystalline melting point of the fluorinated polymer, preferably 25° to 75°C. above same, for a period of 2 to 20 minutes, and preferably of the order of 6 to 10 minutes. The temperature selected depends on the length of the period of sintering, but also on the thickness and composition of the diaphragm.

After cooling, where calcium carbonate is employed as the pore-former, the diaphragm is immersed in a 10 to 20% aqueous solution of a weak acid by weight for a period of time of between 24 and 72 hours, depending on the thickness. Acetic acid is preferably employed, but other weak acids can be used with the same success. This removes the calcium carbonate from the diaphragm. With other pore-formers, other removal agents may be employed, such as any agent in which the pore-former is soluble, but in which the fluorinated polymer is not soluble. Thus for alumina, acid or alkali solutions may be employed. With other metal oxides other dissolving agents may also be employed.

The diaphragm obtained is then washed with water to eliminate the acid, or other dissolving agent for the pore-former, and is kept under water to avoid its hardening.

Due to the wide range of possible variation of the different components of the mixture, one can obtain a diaphragm which satisfies the desired characteristics of permeability and relative electrical resistance.

The method of deposition described above on a fine metal or non-metal grid is conventional. This grid can be removed subsequently from the diaphragm or remain with it, then providing an incorporated reinforcement.

When in certain electrolysis cells the cathode is not developable, the diaphragm can be used as filtration support. The cathode which is immersed in the suspension is impregnated under programmed, increasing vacuum. There are thus obtained diaphragms deposited directly on the cathode which have improved properties, particularly the absence of swelling, while retaining the performance of flat diaphragms. This process of direct deposition of the diaphragm can obviously be applied to flat cathodes. This process, which has the advantage of intimately bonding the cathode to the diaphragm, is very particularly indicated for the production of very fine diaphragms which are necessary for high current densities.

In case of direct depositions on cathode, or the retaining on one of the faces of the diaphragm of the metal filtration grid, the removal of the pore former is effected by an inhibited weak acid, for instance 20% acetic acid, containing 0.1 to 0.5% phenylthiourea.

Finally, in order to obtain variable characteristics in the composition in thickness of the diaphragm, one can successively deposit suspensions of mixtures of variable composition, the proportions of fluorinated resin and of pore former being different, the first thin membrane deposited on the grid serving as filter element for the second charge deposited. One thus succeeds in obtaining a variable porous medium which, however, has no discontinuity which might affect its strength.

DETAILED DESCRIPTION OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified.

EXAMPLE 1

An aqueous suspension of asbestos fibers was prepared by mixing together 100 grams of asbestos of 1 to 2 mm. average length, 900 grams of water, and 5 grams of a 75% by weight solution of sodium dioctylsulfosuccinate in ethyl alcohol. The resulting suspension was uniformly dispersed for 50 minutes with an agitator of the reciprocating type. There were then added to the uniformly dispersed suspension, 130 grams of polytetrafluoroethylene in the form of a latex containing 60% dry extract and 930 grams of calcium carbonate (sold under the trademark "BLE OMYA"). The resulting mixture was then agitated for 5 minutes. It was then diluted with 8300 grams of water and homogenized for 1 to 2 minutes with an apparatus of the reciprocating type.

387 grams of the resulting suspension were then drained over a filter of 1 $dm^2$ (square decimeter) area formed of a bronze screen of a mesh size of 40 microns, applying the following vacuum program or sequence:

1. 1 min. decantation at atmospheric pressure,
2. 2 min. at 200 mm. mercury pressure,
3. 2 min. at 300 mm. mercury pressure, then finally
4. 10 min. at 740 mm. mercury pressure The solid mass deposited on the filter was removed from the filter screen and dried in an oven at 150°C. for 24 hours. The mass deposited was then sintered in a furnace brought to 360°C. for 7 min. The calcium carbonate was dissolved from the mass by aqueous solution of acetic acid of 10% by weight strength for 24 hours followed by an aqueous solution of acetic acid of 20% by weight strength for 48 hours. The resulting diaphragm was washed with water. The resulting flat diaphragm had the following properties:

| | |
|---|---|
| Thickness | 2.75 mm. |
| Relative resistance | 2.2 |
| Tensile strength in | |

-continued

| | |
|---|---|
| the wet state | 11.7 kg/cm² |

The "relative resistance" value is the ratio of the resistance of the medium formed by the electrolyte-soaked diaphragm to the resistance of the same medium formed solely of electrolyte.

The resulting diaphragm, when used as electrode separators in an electrolysis cell for the electrolysis of solutions of sodium chloride, gave the following results, using electrodes formed of a gridding (platinized titanium on the anode side and iron on the cathode side), with spacings of 5 mm.:

| | |
|---|---|
| Current density | 25 amp./dm² |
| Temperature | 85°C. |
| Cell voltage at equilibrium after a few days | 2.95 volts |
| Composition of the alkali: | |
| soda | 120–125 grams/liter |
| chlorate | 0.3–0.4 grams/liter |
| Liquid charge on the diaphragm | 11 cm. of water |

EXAMPLE 2

The procedure of Example 1, above, was repeated with the following changes:

The suspensions employed the following amounts of materials: 100 grams of asbestos, 900 grams of water, 5 grams of the solution of sodium dioctylsulfosuccinate, 180 grams of polytetrafluoroethylene, 1120 grams of calcium carbonate, and 8300 grams of water of final dilution.

The characteristics of the resulting diaphragm (387 grams of suspension per dm²) were as follows:

| | |
|---|---|
| Thickness | 285 mm. |
| Tensile strength | 9.7 kg/cm² (wet) |
| Relative resistance | 2.0 |

Results obtained by the same electrolysis of Example 1 at 25 amp./dm² and 85°C.:

| | |
|---|---|
| Voltage of cell at equilibrium | 3.1 Volts |
| Composition of the alkali: | |
| NaOH | 135–140 grams/liter |
| Chlorate | 0.4–0.6 grams/liter |
| Liquid charge on the diaphragm | 11 cm. of water |

EXAMPLE 3

The procedure of Example 1, above, was repeated with the following changes:

The suspensions employed the following amounts of materials: 100 grams of asbestos, 900 grams of water, 5 grams of the solution of sodium dioctylsulfosuccinate, 100 grams of polytetrafluoroethylene, 800 grams of calcium carbonate, and 8300 grams of water of final dilution.

The final properties of the resulting diaphragm (387 grams of suspension per dm²) were as follows:

| | |
|---|---|
| Thickness | 2.95 mm. |
| Relative resistance | 2.7 |
| Tensile strength in the wet state | 11.3 kg./cm.² |

Results of electrolysis at 25 amp./dm.² and 85°C.:

| | |
|---|---|
| Cell voltage at equilibrium | 3.2 volts |
| Composition of the alkali: | |
| NaOH | 130–140 grams/liter |
| Chlorate | 0.2–0.3 grams/liter |
| Liquid charge on the diaphragm | 28–29 cm of water |

EXAMPLE 4

The procedure of Example 1, above, was repeated with the following changes:

The suspensions employed the following amounts of material: 100 grams of asbestos, 900 grams of water, 7.5 grams of the solution of sodium dioctylsulfosuccinate, 100 grams of polytetrafluoroethylene, 400 grams of calcium carbonate, and 3400 grams of water of final dilution.

The final characteristics of the resulting diaphragm (150 grams of suspension per dm²) were as follows:

| | |
|---|---|
| Thickness | 2.0 mm. |
| Relative resistance | 4.2 |
| Tensile strength in the wet state | 13.6 kg./cm². |

Results of electrolysis at 15 amp./dm². and 85°C.:

| | |
|---|---|
| Cell voltage at equilibrium | 3.15 volts |
| Composition of the alkali: | |
| NaOH | 120 grams/liter |
| Chlorate | 0.3–0.5 grams/liter |
| Liquid charge on the diaphragm | 15 cm. of water |

EXAMPLE 5

The procedure of Example 1, above, was repeated, with the following changes:

The suspensions employed the following amounts of materials: 100 grams of asbestos, 1800 grams of water, 5 grams of the solution of sodium dioctylsulfosuccinate, 100 grams of polytetrafluoroethylene, 800 grams of calcium carbonate, and 7400 grams of water of final dilution.

The characteristics of the resulting diaphragm (195 grams of suspension per dm²) were as follows:

| | |
|---|---|
| Thickness | 1.55 mm. |
| Relative resistance | 1.7 |
| Tensile strength in the wet state | 9.8 kg./cm.² |

Results of electrolysis at 50 amp./dm.² and 85°C.:

| | |
|---|---|
| Cell voltage at equilibrium | 3.35 volts |
| Composition of the alkali: | |
| NaOH | 120 grams/liter |
| Chlorate | 0.6–0.8 grams/liter |
| Liquid charge on the diaphragm | 8–10 cm. of water |

EXAMPLE 6

The procedure of Example 1, above was repeated, but without the use of a surfactant. The suspension was unstable, the dispersion was poorer. The diaphragms obtained were mechanically weaker and performed substantially more poorly in electrolysis.

The composition of the suspension employed was 100 grams of asbestos, 900 grams of water, 180 grams of polytetrafluoroethylene, 1120 grams of calcium carbonate, and 8300 grams of water of final dilution.

The characteristics of the resulting diaphragm (387 grams of suspension per $dm^2$) were:

| | |
|---|---|
| Thickness | 3.05 mm. |
| Relative resistance | 1.9 |
| Tensile strength in the wet state | 3.0 kg./cm.$^2$ |

Results on electrolysis at 25 amp./dm.$^2$ and 85°C.:

| | |
|---|---|
| Cell voltage at equilibrium | 3.15 volts |
| Composition of the alkali: | |
| NaOH | 130 grams/liter |
| Chlorate | 2.0 grams/liter |
| Liquid charge on the diaphragm | 1 cm. |

EXAMPLE 7

The procedure of Example 1 was repeated, but before filtration, a metal screen of bare steel having a square opening of 450 microns was placed on the bronze screen. This metal screen remains enclosed on the cathodic face of the diaphragm produced.

The composition of the suspension employed was 100 grams of asbestos, 900 grams of water, 5 grams of the solution of sodium dioctylsulfosuccinate, 180 grams of polytetrafluoroethylene, 1120 grams of calcium carbonate, and 5000 grams of water of final dilution.

The characteristics of the diaphragm (300 grams of suspension per $dm^2$) were as follows:

| | |
|---|---|
| Thickness | 3.15 mm. |
| Relative resistance | 1.8 |
| Tensile strength in the wet state | not measurable |

Results of electrolysis at 25 amp./dm.$^2$ and 85°C.:

| | |
|---|---|
| Cell voltage at equilibrium | 3.25 volts |
| Composition of the alkali | |
| NaOH | 125–130 grams/liter |
| Chlorate | 0.2 grams/liter |
| Liquid charge on the diaphragm | 15–20 cm. of water |

EXAMPLE 8 (Diaphragm deposited on glove finger)

The procedure of Example 1 was repeated, but without final water dilution of the suspension:

The composition of the suspension was: 100 grams of asbestos of longer fiber lengths (10 to 50 mm.), 930 grams of water, 5 grams of the solution of sodium dioctylsulfosuccinate, 135 grams of polytetrafluoroethylene, and 930 grams of calcium carbonate.

Deposition of diaphragm on glove finger:

The cathode, formed of a glove finger of 70 × 70 × 22 mm. of laminated, woven gridding, was immersed in the above resulting suspension. The impregnation was then effected under a programmed vacuum, namely, 1 minute for each vacuum step (100 – 200 – 300 – 400 – 500 – 700 mm. of mercury pressure). Upon removal from the suspension bath, the cathodic surface was covered with a homogeneous deposit which was dried under vacuum for 20 minutes. After drying in the oven at 150°C. for 24 hours, the resulting "cathode-deposit" unit was brought to 300°–310°C. for 15 minutes and then to 365°C. for 7 minutes. The calcium carbonate is removed therefrom over a period of 4 days by extraction in 20% acetic acid inhibited by 0.2% phenylthiourea.

The glove finger cathode, covered with the diaphragm of 3 mm., was placed in an electrolyzer between two anodes of half a $dm^2$ of expanded titanium covered with noble metals.

In a first test, the interpolar distance D is fixed at 5–6 mm., and in a second test 13–14 mm.

The results obtained at equilibrium, at 25 amp./dm.$^2$ and 85°C., are as follows:

| | |
|---|---|
| Cell voltage for D = 5–6 mm. | 3.1 to 3.2 volts |
| for D = 13–14 mm. | 3.4 to 3.5 volts |
| Composition of the alkali | |
| NaOH | 125 grams/liter |
| Chlorate | 0.7–0.9 grams/liter |

Liquid charge on the diaphragm 20–25 cm. of water as will be apparent to those skilled in the art, from the foregoing description, the polytetrafluoroethylene may be replaced in the foregoing examples with other polymers of fluorinated hydrocarbons, such as polychlorotrifluoroethylene, hexafluoropropylene and the like. The dioctylsuccinate may be replaced with equivalent amounts of other anionic surfactants, such as an alkyl aryl sodium sulfonate, an alkyl naphthalene sodium sulfonate, a sulfonated ester, a fatty alcohol sulfonate, a sulfonated fatty acid amide, etc. The pore-former, calcium carbonate, may be replaced with other finely-divided substances capable of being decomposed or dissolved out of the diaphragm. These include colloidal alumina (dissolvable with aqueous acid or alkali), other metal oxides, and other finely divided solid materials which may be removed by dissolution in a solvent or decomposition.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A method of manufacturing uniform, porous, homogeneous diaphragms of deposited asbestos, having uniform pore sizes, which are consolidated by a fluorinated polymer resin, characterized by agitating a suspension of asbestos fibers in water, a sulfonic anionic surfactant, a fluorinated polymer resin latex and a solid mineral pore-former to form a stable, homogeneous suspension, depositing and filtering said suspension on a screen or grid to form a preform, drying the resulting preform, sintering it by heat alone at a temperature above the crystalline melting point of the fluorinated polymer resin, and finally removing said solid mineral pore-former to form a uniform, porous, homogeneous diaphragm.

2. A method according to claim 1, wherein said fluorinated polymer resin latex and said solid mineral pore-former are added to the suspension of asbestos fibers in water and the sulfonic anionic surfactant.

3. A method according to claim 1, wherein said asbestos is composed of fibers of 0.5 to 50 millimeters in length.

4. A method according to claim 1, wherein said pore-former is a member selected from the group consisting of calcium carbonate, colloidal alumina and metallic oxides.

5. A method according to claim 1, wherein said sulfonic anionic surfactant is a member selected from the group consisting of an alkyl sulfonate, sulfosuccinate and sulfosuccinamate.

6. A method according to claim 4, wherein said sulfonic anionic surfactant is sodium dioctylsulfosuccinate.

7. A method according to claim 1, wherein said various components of the homogeneous suspension are present in the following proportions by weight: about 100 parts of asbestos, about 60 to 200 parts of fluorinated polymer resin, calculated on a dry basis, about 200 to 1400 parts of pore-former, 2 to 10 parts of sulfonic anionic surfactant.

8. A method according to claim 1, wherein said grid or screen remains integral with the resultant diaphragm and forms an incorporated reinforcement.

9. A method according to claim 1, wherein said grid or screen is subsequently separated from the diaphragm.

10. A method according to claim 1, wherein said sintering of the preform is by heat alone and is effected for a period of 2 to 20 minutes.

11. A method according to claim 1, wherein said solid mineral pore-former is removed by decomposition.

12. A method according to claim 1, wherein said solid mineral pore-former is removed by extraction.

* * * * *